US007432029B2

(12) United States Patent
Kim et al.

(10) Patent No.: US 7,432,029 B2
(45) Date of Patent: Oct. 7, 2008

(54) ELECTROPHOTOGRAPHIC PHOTORECEPTOR CONTAINING ASYMMETRICAL NAPHTHALENETETRACARBOXYLIC ACID DIIMIDE DERIVATIVES AND ELECTROPHOTOGRAPHIC IMAGING APPARATUS EMPLOYING THE PHOTORECEPTOR

(75) Inventors: Seung-ju Kim, Suwon-si (KR); Beom-jun Kim, Yongin-si (KR); Ji-Young Lee, Suwon-si (KR); Saburo Yokota, Suwon-si (KR); Kyung-yol Yon, Seongnam-si (KR); Moto Makino, Suwon-si (KR); Hwan-koo Lee, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 320 days.

(21) Appl. No.: 11/320,338

(22) Filed: Dec. 29, 2005

(65) Prior Publication Data

US 2006/0147825 A1 Jul. 6, 2006

(30) Foreign Application Priority Data

Dec. 31, 2004 (KR) ..... 10-2004-0117932

(51) Int. Cl.
*G03G 5/06* (2006.01)

(52) U.S. Cl. ..... 430/60; 430/78; 399/159

(58) Field of Classification Search ..... 430/78, 430/60; 399/159

See application file for complete search history.

(56) References Cited

U.S. PATENT DOCUMENTS

| | | | |
|---|---|---|---|
| 4,468,444 | A | 8/1984 | Contois |
| 5,468,583 | A | 11/1995 | Gruenbaum |
| 5,952,140 | A | 9/1999 | Visser |
| 6,127,076 | A | 10/2000 | Ishigami |
| 6,756,169 | B2 | 6/2004 | Lin |

FOREIGN PATENT DOCUMENTS

| | | |
|---|---|---|
| EP | 0 962 458 | 12/1999 |
| EP | 1 041 653 | 10/2000 |
| EP | 1340755 | 9/2003 |
| EP | 1340755 A1 * | 9/2003 |
| JP | 05-027469 | 2/1993 |
| JP | 2003-345048 | 5/2002 |

OTHER PUBLICATIONS

Sule Erten, Yevgen Posokhov, Serap Alp and Siddik Içli, "The study of the solubility of naphthalene diimides with various bulky flanking substituents in different solvents by UV-vis spectroscopy", Dyes and Pigments, vol. 64, Issue 2, Feb. 2005, pp. 171-178.*

Diamond, Arthur S & David Weiss (eds.) Handbook of Imaging Materials, 2nd ed . . . New York: Marcel-Dekker, Inc. (Nov. 2001) pp. 145-164.*

* cited by examiner

*Primary Examiner*—Christopher RoDee
(74) *Attorney, Agent, or Firm*—Roylance, Abrams, Berdo & Goodman, L.L.P.

(57) ABSTRACT

An electrophotographic photoreceptor is provided containing a specific asymmetric naphthalenetetracarboxylic acid diimide derivative having a nitro group. An electrophotographic imaging apparatus, an electrophotographic cartridge, and an electrophotographic drum employing the electrophotographic photoreceptor are also provided. The naphthalenetetracarboxylic acid diimide derivative has high solubility in an organic solvent, compatibility with a binder resin, and electron transporting ability. The electrophotographic photoreceptor manufactured using the naphthalenetetracarboxylic acid diimide derivatives has an excellent electrostatic property.

10 Claims, 2 Drawing Sheets

ELECTROPHOTOGRAPHIC PHOTORECEPTOR CONTAINING ASYMMETRICAL NAPHTHALENETETRACARBOXYLIC ACID DIIMIDE DERIVATIVES AND ELECTROPHOTOGRAPHIC IMAGING APPARATUS EMPLOYING THE PHOTORECEPTOR

BACKGROUND OF THE INVENTION

This application claims the benefit of Korean Patent Application No. 10-2004-0117932, filed on Dec. 31, 2004, in the Korean Intellectual Property Office, the disclosure of which is incorporated herein by reference in its entirety.

FIELD OF THE INVENTION

The present invention relates to an electrophotographic photoreceptor, and an electrophotographic imaging apparatus, an electrophotographic cartridge, and an electrophotographic drum employing the electrophotographic photoreceptor. More particularly, the present invention relates to an electrophotographic photoreceptor containing specific asymmetric naphthalenetetracarboxylic acid diimide derivatives having a nitro group which have a high solubility in an organic solvent and high compatibility with a binder resin, thus providing excellent electron transporting ability. The invention is also directed to an electrophotographic imaging apparatus, an electrophotographic cartridge, and an electrophotographic drum employing the electrophotographic photoreceptor.

DESCRIPTION OF THE RELATED ART

An electrophotographic photoreceptor is used in electrophotography applied to laser printers, photocopiers, CRT printers, facsimile machines, LED printers, liquid crystal printers, and laser electrophotos, etc. The electrophotographic photoreceptor comprises a photosensitive layer formed on an electrically conductive substrate. The substrate can be in the form of a plate, a disk, a sheet, a belt, or a drum, etc. In electrophotography, an image is formed using an electrophotographic photoreceptor. First, a surface of the photosensitive layer is electrostatically charged uniformly, and then the charged surface is exposed to a pattern of light, thus forming an image. The light exposure selectively dissipates the charge in the exposed regions where the light strikes the surface, thereby forming a pattern of charged and uncharged regions, which is referred to as a latent image. Then, a wet or dry toner is applied in the vicinity of the latent image, and toner droplets or particles deposit in either the charged or uncharged regions to form a toner image on the surface of the photosensitive layer. The resulting toner image can be transferred and fixed to a suitable ultimate or intermediate receiving surface, such as paper, or the photosensitive layer can function as the ultimate receptor for receiving the image. After that, the residual toner is cleaned and residual charges are erased from the electrophotographic photoreceptor. Thus, the electrophotographic photoreceptor can be repeatedly used for long periods.

Electrophotographic photoreceptors are generally categorized into two types. The first is a laminated type having a laminated structure including a charge generating layer comprising a binder resin and a charge generating material (CGM), and a charge transporting layer comprising a binder resin and a hole transporting material (HTM). In general, the laminated type electrophotographic photoreceptor is used in the fabrication of a negative (−) type electrophotographic photoreceptor. The other type is a single layered type in which a binder resin, a CGM, an HTM, and an electron transporting material (ETM) are contained in a single layer. In general, the single layered type photoreceptor is used in the fabrication of a positive (+) type electrophotographic photoreceptor.

The (+) type single layered electrophotographic photoreceptor is advantageous in that it generates a small amount of ozone harmful to humans and since it has a single photosensitive layer, its production costs are low. The most essential material among the materials composing the (+) type single layered electrophotographic photoreceptor is the ETM. Since the hole transporting ability of the HTM is at least a hundred times greater than the electron transporting ability of the commonly used ETM, the performance of the single layered electrophotographic photoreceptor is dependent upon the electron transporting ability of the ETM.

The electron transporting ability of the ETM is greatly affected by its solubility in an organic solvent and compatibility with a polymer binder resin. The conventional ETM includes a dicyanofluorenone derivative having Formula (i) below, a diphenoquinone derivative having Formula (ii) below, a naphthalenetetracarboxylic acid diimide derivative having Formula (iii) (see U.S. Pat. Nos. 4,992,349 and 4,442,193), and a naphthalenetetracarboxylic acid diimide derivative having Formula iv (see U.S. Pat. No. 6,127,076), etc.:

(i)

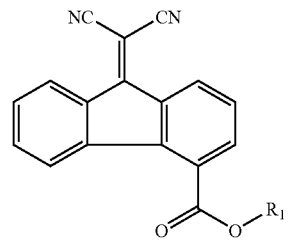

wherein $R_1$ is a substituted or unsubstituted alkyl group or an aryl group, etc.

(ii)

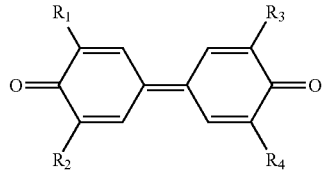

wherein each of $R_1$, $R_2$, $R_3$, and $R_4$ is independently a substituted or unsubstituted alkyl group, a cycloalkyl group, an aryl group, or an alkoxy group, (iii)

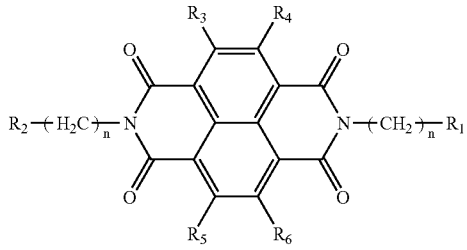

wherein $R_1$ and $R_2$ are independently a substituted or unsubstituted aryl group, a sulfonyl group, a sulfone group, etc., $R_3$, $R_4$, $R_5$, and $R_6$ are independently a hydrogen atom, a $C_{1-4}$ alkyl group, a $C_{1-4}$ alkoxy group, or a halogen atom, and n is 0-3, (iv)

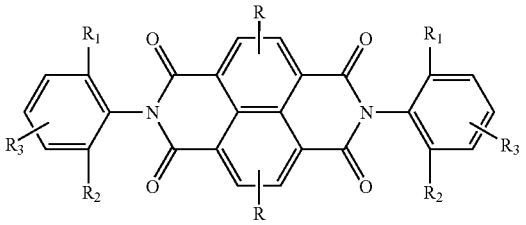

wherein

R is a hydrogen atom, an alkyl group, an alkoxyl group, or a halogen atom, $R_1$ and $R_2$ are different from each other and each a substituted or unsubstituted alkyl group, an alkoxyl group, or an aryl group, $R_3$ is a hydrogen atom, a substituted or unsubstituted alkyl group, an alkoxyl group, or an aryl group.

The dicyanofluorenone derivative of Formula (i) and the diphenoquinone derivative of Formula (ii) have low solubility in an organic solvent and low inherent electron transporting ability. Thus, electrophotographic photoreceptors manufactured using the derivative (i) or (ii) as the ETM have disadvantages such as a remarkably reduced charge potential and an increased exposure potential after repeated charging exposures.

The naphthalenetetracarboxylic acid diimide derivatives of Formulae (iii) and (iv) are known to have high electron transporting ability. However, these derivatives of Formulae (iii) and (iv) have low solubility in an organic solvent and low compatibility with a polymer binder resin. Electrophotographic photoreceptors manufactured using these derivatives have surfaces of the photosensitive layers that may crystallize, thus adversely affecting the electrostatic properties of the photoreceptors.

Thus, electrophotographic photoreceptors, especially single layered type electrophotographic photoreceptors, manufactured using the conventional ETMs have a remarkably reduced charge potential and an increased exposure potential after repeated use. In general, surface charges of electrophotographic photoreceptors must be maintained at a predetermined potential. Due to the decrease in the charge potential and the increases in the exposure potential, image qualities may be deteriorated.

SUMMARY OF THE INVENTION

The present invention provides an electrophotographic photoreceptor containing a specific naphthalenetetracarboxylic acid diimide derivative having high solubility in an organic solvent, higher compatibility with a polymer binder resin, and thus provides better electron transporting ability.

The present invention also provides an electrophotographic imaging apparatus, an electrophotographic cartridge, and an electrophotographic drum using the electrophotographic photoreceptor of the invention.

The present invention also provides the specific naphthalenetetracarboxylic acid diimide derivatives.

According to an aspect of the present invention, there is provided an electrophotographic photoreceptor comprising:

an electrically conductive substrate; and a photosensitive layer formed on the support, wherein the photosensitive layer comprises a naphthalenetetracarboxylic acid diimide derivative having formula (1):

(1)

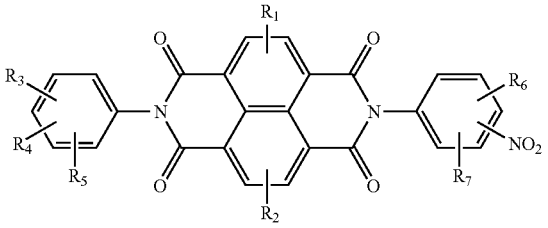

wherein each of $R_1$, $R_2$, $R_3$, $R_4$, $R_5$, $R_6$, and $R_7$ is independently one selected from the group consisting of a hydrogen atom, a halogen atom, a substituted or unsubstituted $C_{1-20}$ alkyl group, a substituted or unsubstituted $C_{1-20}$ alkoxy group, a substituted or unsubstituted $C_{6-30}$ aryl group, and a substituted or unsubstituted $C_{7-30}$ aralkyl group.

According to another aspect of the present invention, there is provided an electrophotographic photoreceptor comprising:

an electrically conductive substrate;

an intermediate layer formed on the electrically conductive substrate; and a photosensitive layer formed on the intermediate layer, wherein the intermediate layer comprises a naphthalenetetracarboxylic acid diimide derivative having formula (1) defined above.

According to still another aspect of the present invention, there is provided an electrophotographic imaging apparatus comprising:

an electrophotographic photoreceptor comprising:

an electrically conductive substrate; and a photosensitive layer formed on the electrically conductive support, wherein the photosensitive layer comprises a naphthalenetetracarboxylic acid diimide derivative having formula (1) defined above.

According to still another aspect of the present invention, there is provided an electrophotographic imaging apparatus comprising:

an electrophotographic photoreceptor comprising:

an electrically conductive substrate;

an intermediate layer formed on the electrically conductive substrate; and a photosensitive layer formed on the intermediate layer, wherein the intermediate layer comprises a naphthalenetetracarboxylic acid diimide derivative having formula (1) defined above.

According to still another aspect of the present invention, there is provided an electrophotographic cartridge comprising:

an electrophotographic photoreceptor comprising:
an electrically conductive substrate; and
a photosensitive layer formed on the electrically conductive support,
wherein the photosensitive layer comprises
a naphthalenetetracarboxylic acid diimide derivative having formula (1) indicated above; and
at least one selected from the group consisting of:
a charging device for charging the electrophotographic photoreceptor;
a developing device for developing an electrostatic latent image formed on the electrophotographic photoreceptor; and
a cleaning device for cleaning a surface of the electrophotographic photoreceptor,
the electrophotographic cartridge being attachable to or detachable from an imaging apparatus.

According to still another aspect of the present invention, there is provided an electrophotographic cartridge comprising:
an electrophotographic photoreceptor comprising:
a electrically conductive substrate;
an intermediate layer formed on the electrically conductive substrate; and
a photosensitive layer formed on the intermediate layer,
wherein the intermediate layer comprises a naphthalenetetracarboxylic acid diimide derivative having formula (1) defined above; and
at least one selected from the group consisting of:
a charging device for charging the electrophotographic photoreceptor;
a developing device for developing an electrostatic latent image formed on the electrophotographic photoreceptor; and
a cleaning device for cleaning a surface of the electrophotographic photoreceptor,
the electrophotographic cartridge being attachable to or detachable from an imaging apparatus.

According to still another aspect of the present invention, there is provided an electrophotographic drum comprising:
a drum attachable to and detachable from an imaging apparatus; and
an electrophotographic photoreceptor disposed on the drum,
the electrophotographic photoreceptor comprising:
an electrically conductive substrate; and
a photosensitive layer formed on the electrically conductive substrate,
wherein the photosensitive layer comprises a naphthalenetetracarboxylic acid diimide derivative having formula (1) defined above.

According to still another aspect of the present invention, there is provided an electrophotographic drum comprising:
a drum attachable to and detachable from an imaging apparatus; and
an electrophotographic photoreceptor disposed on the drum,
the electrophotographic photoreceptor comprising:
an electrically conductive substrate;
an intermediate layer formed on the electrically conductive substrate; and
a photosensitive layer formed on the intermediate layer,
wherein the intermediate layer comprises a naphthalenetetracarboxylic acid diimide derivative having formula (1) defined above.

According to still another aspect of the present invention, there is provided an imaging apparatus comprising:
a photoreceptor unit comprising:
an electrically conductive substrate; and
a photosensitive layer formed on the electrically conductive support,
wherein the photosensitive layer comprises
a naphthalenetetracarboxylic acid diimide derivative having formula (1) defined above;
a charging device for charging the photoreceptor unit;
an imageforming light irradiating device for irradiating light onto the charged photoreceptor unit to form an electrostatic latent image on the photoreceptor unit;
a developing unit for developing the electrostatic latent image with a toner to form a toner image on the photoreceptor unit; and
a transfer device for transferring the toner image onto a receptor.

According to still another aspect of the present invention, there is provided an imaging apparatus comprising:
a photoreceptor unit comprising:
an electrically conductive substrate;
an intermediate layer formed on the electrically conductive substrate; and
a photosensitive layer formed on the intermediate layer,
wherein the intermediate layer comprises a naphthalenetetracarboxylic acid diimide derivative having formula (1) defined above;
a charging device for charging the photoreceptor unit;
an imageforming light irradiating device for irradiating light onto the charged photoreceptor unit to form an electrostatic latent image on the photoreceptor unit;
a developing unit for developing the electrostatic latent image with a toner to form a toner image on the photoreceptor unit; and
a transfer device transferring the toner image onto a receptor.

The asymmetric naphthalenetetracarboxylic acid diimide derivative containing a nitro group and having formula (1) exhibiting higher solubility in an organic solvent, compatibility with a polymer binder resin, and electron transporting ability than the prior naphthalenetetracarboxylic acid diimide derivatives. Thus, the naphthalenetetracarboxylic acid diimide derivative having formula (1) can be advantageously used as an electron transporting material (ETM) in an electrophotographic photoreceptor, especially in a single layered type electrophotographic photoreceptor. The naphthalenetetracarboxylic acid diimide derivative having formula (1) is added to an intermediate layer of an electrophotographic photoreceptors, especially in a laminated type electrophotographic photoreceptors comprising a charge generating layer and a charge transporting layer, to lower the exposure potentials and prevent charges, especially holes from being injected from a substrate into a photosensitive layer.

These and other features of the invention will become apparent from the following detailed description of the invention which disclose various embodiments of the invention.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
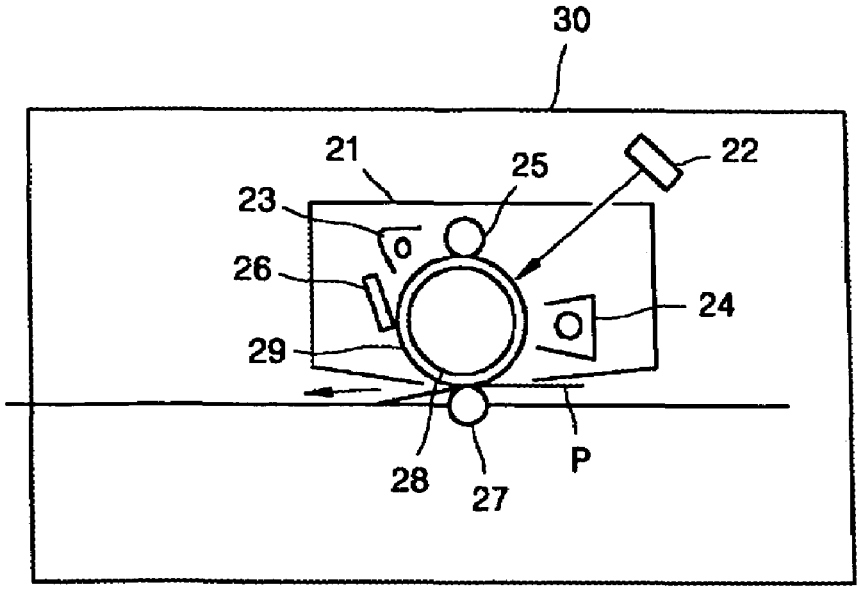
FIG. 1 is a schematic illustration of an imaging apparatus, an electrophotographic photoreceptor drum, and an electrophotographic cartridge according to an embodiment of the present invention.

The invention is directed to an electrophotographic photoreceptor, and an electrophotographic imaging apparatus, an electrophotographic cartridge, and an electrophotographic drum including the electrophotographic photoreceptor.

The naphthalenetetracarboxylic acid diimide derivative of Formula (1) according to the present invention has an asymmetric structure and therefor has a high solubility in an organic solvent and high compatibility with a polymer binder resin. Furthermore, due to introduction of a nitro group on one of the terminal aryl groups, which has high electron affinity, the naphthalenetetracarboxylic acid diimide derivative of Formula (1) has high electron transporting ability. Thus, when the naphthalenetetracarboxylic acid diimide derivative of Formula (1) is used as an electron transporting material (ETM) in an electrophotographic photoreceptor, the electrophotographic photoreceptor has an excellent electrostatic property.

The naphthalenetetracarboxylic acid diimide of Formula 1 is as follows:

(1)

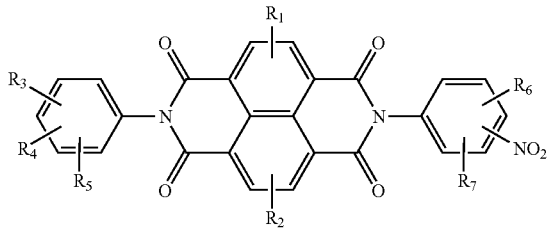

wherein $R_1$, $R_2$, $R_3$, $R_4$, $R_5$, $R_6$, and $R_7$ are independently selected from the group consisting of a hydrogen atom, a halogen atom, a substituted or unsubstituted $C_{1-20}$ alkyl group, a substituted or unsubstituted $C_{1-20}$ alkoxy group, a substituted or unsubstituted $C_{6-30}$ aryl group, and a substituted or unsubstituted $C_{7-30}$ aralkyl group.

The halogen atom can be fluorine, chlorine, bromine, or iodine.

The alkyl group is a $C_{1-20}$, preferably $C_{1-12}$, linear or branched alkyl group. Examples of suitable alkyl groups include methyl, ethyl, n-propyl, isopropyl, n-butyl, isobutyl, sec-butyl, tert-butyl, pentyl, hexyl, 1,2-dimethylpropyl, 2-ethylhexyl, and the like. The alkyl group may be substituted with a halogen atom, for example, fluorine, chlorine, bromine or iodine.

The alkoxy group is a $C_{1-20}$, preferably $C_{1-12}$, linear or branched alkoxy group. Examples of the alkoxy group include methoxy, ethoxy, propoxy, and the like. The alkoxy group may be substituted with a halogen atom, for example, fluorine, chlorine, bromine or iodine.

The aralkyl group is a $C_{7-30}$, preferably $C_{7-15}$, linear or branched aralkyl group. Examples of the aralkyl group include benzyl, methylbenzyl, phenylethyl, naphthylmethyl, naphthylethyl, and the like. The aralkyl group may be substituted with a halogen atom, for example, fluorine, chlorine, bromine or iodine, an alkyl group, an alkoxy group, a nitro group, a hydroxy group, a sulfonic acid group, and the like.

The aryl group is a $C_{6-30}$ aromatic ring. Examples of the aryl group include phenyl, tolyl, xylyl, biphenyl, o-terpenyl, naphtyl, anthracenyl, phenanthrenyl, and the like. The aryl group may be substituted with an alkyl group, an alkoxy group, a nitro group, a hydroxy group, a sulfonic acid group, or a halogen atom, and the like.

Specific examples of the naphthalenetetracarboxylic acid diimide derivative of Formula (1) include the following:

Compound (1)

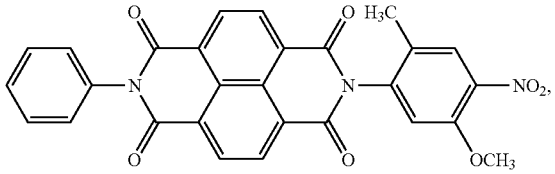

Compound (2)

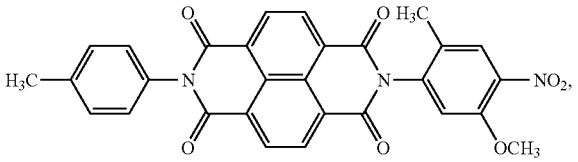

Compound (3)

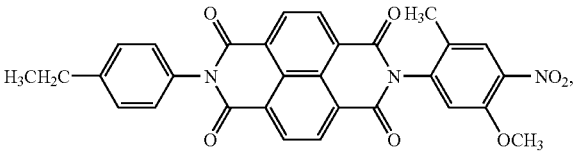

Compound (4)

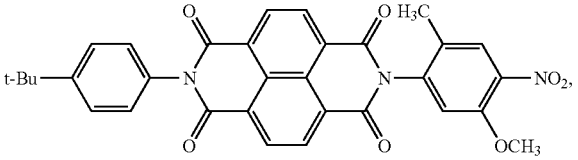

Compound (5)

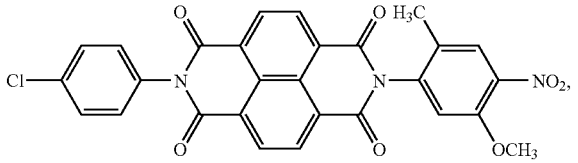

Compound (6)

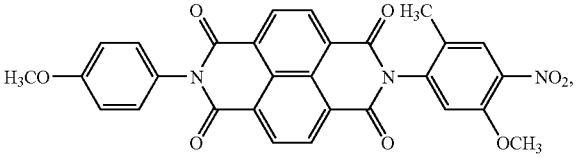

-continued

Compound (7)

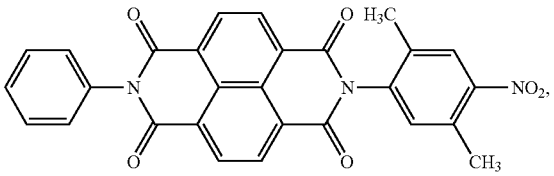

Compound (8)

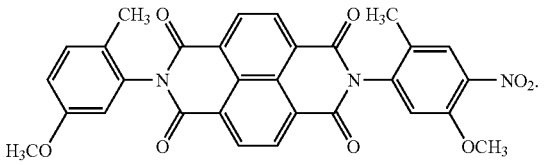

As seen from the chemical structures of Compounds (1) through (8), the naphthalenetetracarboxylic acid diimide derivative of Formula (1) has the asymmetric structure. The term "asymmetric" means that two phenyl rings attached to N atoms of two imide bonds in the structure of naphthalenetetracarboxylic acid are substituted with substituents which are different from each other. Due to the asymmetric structure, the diimide derivative of Formula (1) has high solubility in an organic solvent and high compatibility with a polymer binder resin, thus providing excellent electron transporting ability. Furthermore, the introduction of a nitro group, which has high electron affinity, produces a diimide derivative of Formula (1) having increased electron transporting ability compared to the prior compositions. In one embodiment, the nitro group is in the 4-position on the aryl group.

A method of producing the naphthalenetetracarboxylic acid diimide derivative of Formula (1) will now be described.

The naphthalenetetracarboxylic acid diimide derivative of Formula (1) is obtained by reacting a naphthalenetetracarboxylic acid dianhydride having formula (2) with aniline-based compounds having formulae (3) and (4):

(2)

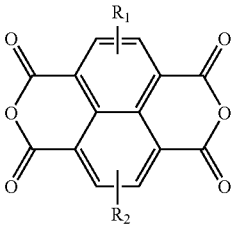

(3)

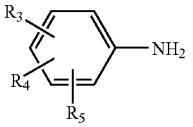

(4)

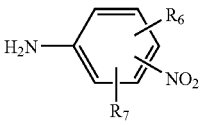

wherein $R_1$, $R_2$, $R_3$, $R_4$, $R_5$, $R_6$, and $R_7$ are as defined above.

A polar organic solvent, for example, dimethylformamide (DMF), dimethylacetamide (DMAc), hexamethylphosphoramide (HMPA), or N-methyl-2-pyrrolidone (NMP), may be used for the reaction. The reaction temperature may be set in the range of 20° C. lower than a boiling point of the solvent to the boiling point of the solvent, and preferably, in the range of 10° C. lower than the boiling point of the solvent to the boiling point of the solvent.

Generally, the reaction may be carried out as follows. First, the naphthalenetetracarboxylic acid dianhydride having formula (2) is dissolved in an organic solvent, for example, DMF, DMAc, HMPA, or NMP, and then the aniline-based compounds having formulae (3) and (4) are added dropwise to the resultant solution. Then, the resultant mixture is refluxed 3-24 hours, preferably 3-10 hours, to obtain the asymmetric naphthalenetetracarboxylic acid diimide derivative of Formula (1). In this reaction, the naphthalenetetracarboxylic acid dianhydride of Formula (2), the aniline-based compound of Formula (3), and the aniline-based compound of Formula (4) may be used in a molar ratio of 1:1:1. When the aniline-based compound of Formula (3) is attached to both nitrogen atoms of imides in the compound of Formula (2), or when the aniline-based compound of Formula (4) is attached to both nitrogen atoms of imides in the compound of Formula (2), a symmetric naphthalenetetracarboxylic acid diimide derivative is obtained. This symmetric naphthalenetetracarboxylic acid diimide derivative has a much lower solubility in an organic solvent than the asymmetric naphthalenetetracarboxylic acid diimide derivative of Formula (1) according to the present invention. Accordingly, using a difference in the solubilities, the asymmetric naphthalenetetracarboxylic acid diimide derivative can be isolated from the reaction mixture.

An electrophotographic imaging apparatus, an electrophotographic photoreceptor drum, and an electrophotographic cartridge employing the electrophotographic photoreceptor containing the naphthalenetetracarboxylic acid diimide derivative of Formula (1) will now be described in detail.

FIG. 1 schematically illustrates an image forming apparatus 30 including an electrophotographic photoreceptor drum 28, 29 and an electrophotographic cartridge 21 according to an embodiment of the present invention. The electrophotographic cartridge 21 typically includes an electrophotographic photoreceptor 29, one or more charging devices 25 charging the electrophotographic photoreceptor 29, a developing device 24 developing an electrostatic latent image formed on the electrophotographic photoreceptor 29, and a cleaning device 26 cleaning a surface of the electrophotographic photoreceptor 29. The electrophotographic cartridge 21 can be attached to and detached from the image forming apparatus 30.

The electrophotographic photoreceptor drum 28, 29 of the image forming apparatus 30 can generally be attached to and detached from the image forming apparatus 30 and includes the drum 28 on which the electrophotographic photoreceptor 29 is placed.

Generally, the image forming apparatus 30 includes a photosensitive unit (for example, the drum 28 and the electrophotographic photoreceptor 29); the charging device 25 for charging the photoreceptor unit; an imageforming light for irradiating device 22 for irradiating light onto the charged photoreceptor unit to form an electrostatic latent image on the photoreceptor unit; the developing unit 24 for developing the electrostatic latent image with a toner to form a toner image on the photoreceptor unit; and a transfer device 27 for transferring the toner image onto a receiving material, such as paper P, and the photoreceptor unit includes the electrophotographic photoreceptor 29, which will be described below.

The charging device 25 may be supplied with a voltage as a charging unit and may charge the electrophotographic photoreceptor 29. The image forming apparatus 30 may also include a pre-exposure unit 23 to erase residual charge on the surface of the electrophotographic photoreceptor 29 to prepare for a next cycle.

The photoreceptor including the naphthalenetetracarboxylic acid diimide derivative of Formula (1) according to the present invention can be incorporated into electrophotographic imaging apparatuses, such as laser printers, photocopiers, and facsimile machines.

Hereinafter, an electrophotographic photoreceptor containing the naphthalenetetracarboxylic acid diimide derivative of Formula (1), which is employed in the electrophotographic imaging apparatus, etc. according to an embodiment of the present invention, will be described in more detail.

The electrophotographic photoreceptor comprises a photosensitive layer formed on an electrically conductive substrate. The electrically conductive substrate may be composed of metal, an electrically conductive polymer, or other materials and is produced in the form of a plate, a disk, a sheet, a belt, or a drum. Examples of the metal include aluminum and stainless steel. Examples of the electrically conductive polymer include polyester resin, polycarbonate resin, polyamide resin, polyimide resin, mixtures thereof, and a copolymer thereof in which an electrically conductive material, such as electrically conductive carbon, tin oxide, indium oxide, is dispersed.

The photosensitive layer may be a laminated type where a charge generating layer and a charge transporting layer are separately formed, or a single layered type where a layer acts as both a charge generating layer and a charge transporting layer.

The naphthalenetetracarboxylic acid diimide derivative of Formula (1) according to the present invention acts as a charge transporting material, and preferably, as an ETM. In the laminated type photosensitive layer, the naphthalenetetracarboxylic acid diimide derivative of Formula (1) is contained in the charge transporting layer, and in the single layered type photosensitive layer, it is naturally contained in a single layer together with a charge generating material (CGM).

Examples of the CGM used in the photosensitive layer include organic materials such as phthalocyanine pigments, azo pigments, quinone pigments, perylene pigments, indigo pigments, bisbenzoimidazole pigments, quinacridone pigments, azulenium dyes, squarylium dyes, pyrylium dyes, triarylmethane dyes, and cyanine dyes, and inorganic materials such as amorphous silicon, amorphous selenium, trigonal selenium, tellurium, selenium-tellurium alloy, cadmium sulfide, antimony sulfide, and zinc sulfide. The CGM is not limited to the materials listed herein, and may be used alone or in a combination of two or more.

In case of the laminated type photoreceptor, the CGM is dispersed in a solvent with a binder resin and then the dispersion is coated on the electrically conductive substrate by a dip coating, a ring coating, a roll coating, or a spray coating method to form the charge generating layer. The thickness of the charge generating layer is generally about 0.1-1 μm. When the thickness is less than 0.1 μm, the sensitivity is insufficient, and when the thickness is greater than 1 μm, the charging ability and the sensitivity are lowered.

A charge transport layer containing the naphthalenetetracarboxylic acid diimide derivative of Formula (1) is formed on the charge generating layer of the laminated type photosensitive layer, but the charge generating layer may be formed on the charge transport layer in reverse order. When forming the charge transport layer, the naphthalenetetracarboxylic acid diimide derivative of Formula (1) and the binder resin are dissolved in a solvent and the resulting solution is coated on the charge generating layer. Examples of the coating method include a dip coating, a ring coating, a roll coating, and a spray coating method, similar to the methods used to form the charge generating layer. The thickness of the charge transport layer is generally about 5-50 μm. When the thickness is less than 5 μm, the charging ability becomes poor, and when the thickness is greater than 50 μm, the response rate is reduced and the image quality is deteriorated.

When preparing the single layered photoreceptor, the CGM is dispersed in a solvent together with the binder resin and the naphthalenetetracarboxylic acid diimide derivative of Formula (1) as the ETM and the resulting dispersion is coated on the electrically conductive substrate to obtain the photosensitive layer. The thickness of the photosensitive layer is generally about 5-50 μm. The naphthalenetetracarboxylic acid diimide derivative of Formula (1) may be used together with other ETM and/or HTM. Especially, in the single layered photoreceptor, it is preferable to use the naphthalenetetracarboxylic acid diimide derivative of Formula (1) together with the HTM.

Examples of the HTM that may be used with the naphthalenetetracarboxylic acid diimide derivative of Formula (1) in the photosensitive layer include nitrogen containing cyclic compounds or condensed polycyclic compounds such as pyrene compounds, carbazole compounds, hydrazone compounds, oxazole compounds, oxadiazole compounds, pyrazoline compounds, arylamine compounds, arylmethane compounds, benzidine compounds, thiazole compounds or styryl compounds. Also, high molecular weight compounds having functional groups of the above compounds on a backbone or side chain may be used.

Examples of other ETM that may be used with the naphthalenetetracarboxylic acid diimide derivative of Formula (1) in the photosensitive layer include, but are not limited to, electron attracting low-molecular weight compounds such as benzoquinone compounds, cyanoethylene compounds, cyanoquinodimethane compounds, fluorenone compounds, xanthone compounds, phenanthraquinone compounds, anhydrous phthalic acid compounds, thiopyrane compounds, or diphenoquinone compounds. Electron transporting polymer compounds or pigments having n-type semiconductor characteristic may also be used.

The ETM or the HTM that may be used with the naphthalenetetracarboxylic acid diimide derivative of Formula (1) in the electrophotographic photoreceptor are not limited to the materials listed herein, and the foregoing materials may be used alone or in combination of two or more.

Examples of solvents used in preparing a coating composition for forming the photosensitive layer include organic solvents such as alcohols, ketones, amides, ethers, esters, sulfones, aromatics, halogenated aliphatic hydrocarbons, and the like. The coating method of the coating composition may be a dip coating method, but a ring coating, a roll coating, a spray coating method, or the like may be also used.

Examples of the binder resin used in the formation of the photosensitive layer include, but are not limited to, polycarbonate, polyester, methacryl resin, acrylic resin, polyvinyl chloride, polyvinylidene chloride, polystyrene, polyvinyl acetate, silicon resin, silicon-alkyd resin, styrene-alkyd resin, poly-N-vinylcarbazole, phenoxy resin, epoxy resin, polyvinyl butyral, polyvinyl acetal, polyvinyl formal, polysulfone, polyvinyl alcohol, ethyl cellulose, phenolic resin, polyamide, carboxy-methyl cellulose and polyurethane. These polymers may be used alone or in a combination of two or more.

The amount of the CTM including the ETM and the HTM in the photoconductive layer may be in the range of 10-60% by weight based on total weight of the photosensitive layer. If the amount is less than 10% by weight, the sensitivity is insufficient due to low charge transporting ability, thereby resulting in an increased residual potential. If the amount is more than 60% by weight, the amount of the resin in the photosensitive layer is reduced, thereby reducing mechanical strength.

In an embodiment of the present invention, an electroconductive layer may further be formed between the substrate and the photosensitive layer. The electroconductive layer is obtained by dispersing an electroconductive powder such as carbon black, graphite, metal powder or metal oxide powder in a solvent and then applying the resulting dispersion on the substrate and drying it. The thickness of the electroconductive layer may be about 5-50 μm.

In addition, an intermediate layer may be interposed between the substrate and the photosensitive layer or between the electroconductive layer and the photosensitive layer to enhance adhesion or to prevent charges from being injected from the substrate. Examples of the intermediate layer include, but are not limited to, an aluminum anodized layer; a resin-dispersed layer in which metal oxide powder such as titanium oxide or tin oxide is dispersed; and a resin layer such as polyvinyl alcohol, casein, ethylcellulose, gelatin, phenol resin, or polyamide. The thickness of the intermediate layer may be about 0.05-5 μm.

Also, each of the photosensitive layer, the electroconductive layer, and the intermediate layer may further comprise at least one additive selected from a plasticizer, a leveling agent, a dispersion stabilizing agent, an antioxidant, and an optical stabilizer, in addition to the binder resin.

Examples of the antioxidant include phenol compounds, sulfur compounds, phosphorus compounds, or amine compounds. Examples of the optical stabilizer include benzotriazole compounds, benzophenone compounds, or hindered amine compounds.

The electrophotographic photoreceptor according to an embodiment of the present invention may further comprise a surface protecting layer, if necessary.

Hereinafter, the present invention will be described in more detail with reference to the following examples. However, these examples are given for the purpose of illustration and are not intended to limit the scope of the invention.

EXAMPLES

Synthesis Example 1

Synthesis of Compound (1)

The following is a description of the synthesis of the naphthalenetetracarboxylic acid diimide Compound (1) having the formula below.

(1)

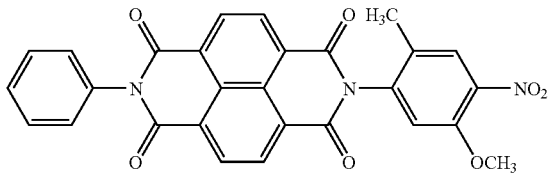

Figure 2:
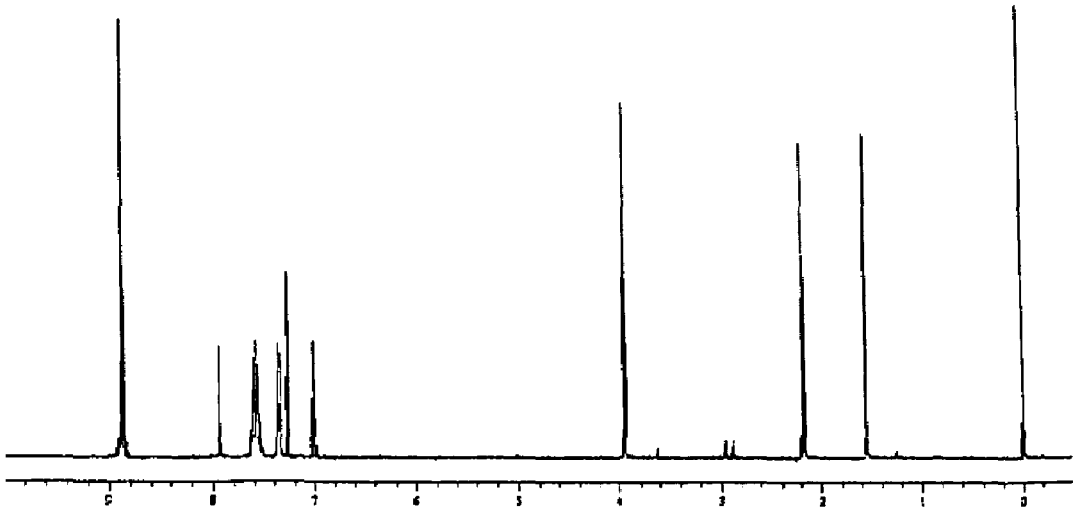
FIG. 2 is an NMR spectrum of a naphthalenetetracarboxylic acid diimide derivative (1) obtained by the Synthesis of Example 1 according to an embodiment of the present invention.

A 250 ml three neck flask equipped with a reflux condenser was purged with nitrogen, and then 13.4 g (0.05 mol) of naphthalene-1,4,5,8-tetracarboxylic acid dianhydride and 500 ml of DMF were poured thereinto and stirred to obtain a solution. After the solution was warmed to a reflux temperature, a solution of 9.15 g (0.05 mol) of 5-methoxy-2-methyl-4-nitroaniline and 4.7 g (0.05 mol) of aniline in 50 ml of DMF was slowly added dropwise to the flask, and then the mixture was refluxed for 4 hours and then cooled to room temperature. The mixture was added to 1000 ml of methanol and precipitated to obtain a solid. The resultant solid was recrystallized from a chloroform/methanol solvent and dried in a vacuum to obtain 22.0 g of the compound (1) as light yellow crystals (yield 88%). The $^1$H-NMR (300 MHz, $CDCl_3$) spectrum of the obtained Compound (1) is shown in FIG. 2.

Synthesis Example 2

Synthesis of Compound (2)

The following is a description of the synthesis of the naphthalenetetracarboxylic acid diimide Compound (2) having the formula below.

(2)

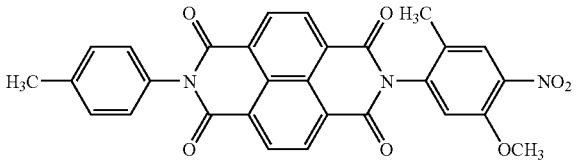

Figure 3:
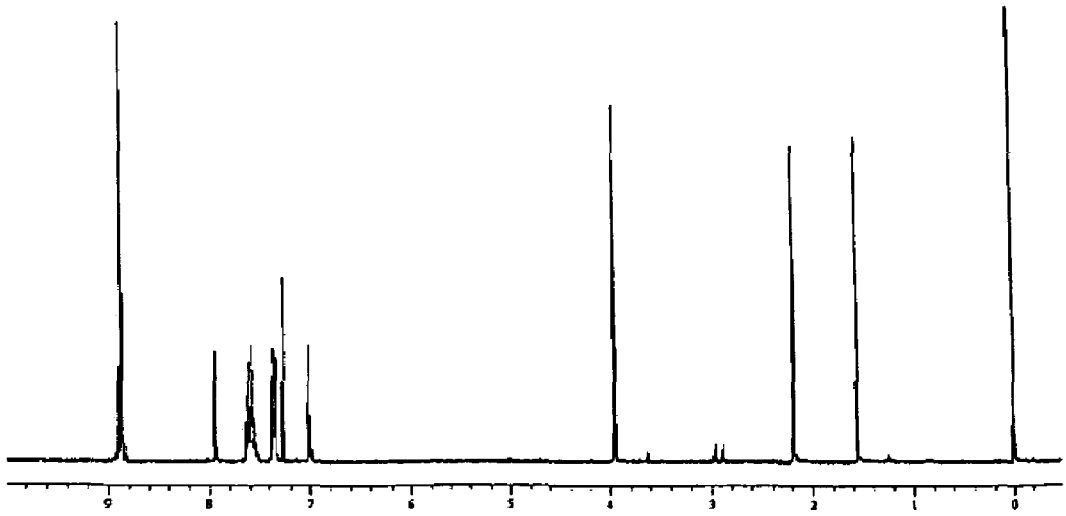
FIG. 3 is an NMR spectrum of a naphthalenetetracarboxylic acid diimide derivative (2) obtained by the Synthesis of Example 2 according to an embodiment of the present invention.

21.2 g of the naphthalenetetracarboxylic acid diimide compound (2) was prepared as light yellow crystals in the same manner as in Synthesis Example 1, except that 5.34 g (0.05 mol) of 4-methylaniline was used instead of aniline (yield 81%). The $^1$H-NMR (300 MHz, $CDCl_3$) spectrum of the obtained Compound (2) is shown in FIG. 3.

Synthesis Example 3

Synthesis of Compound (8)

The following is a description of the synthesis of the naphthalenetetracarboxylic acid diimide Compound (8) having the formula below.

(8)

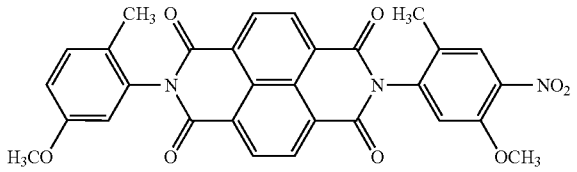

Figure 4:
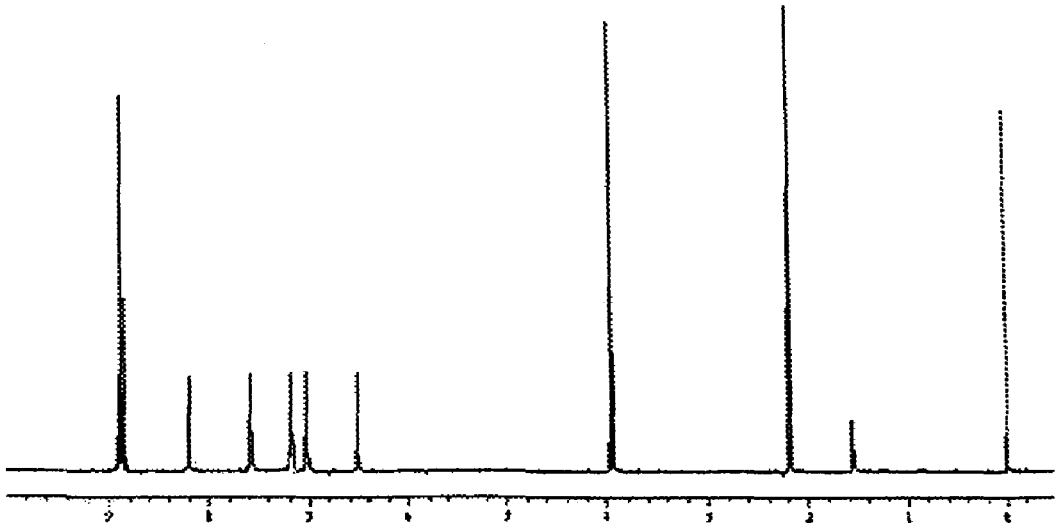
FIG. 4 is an NMR spectrum of a naphthalenetetracarboxylic acid diimide derivative (8) obtained by the Synthesis of Example 3 according to an embodiment of the present invention.

22.8 g of the naphthalenetetracarboxylic acid diimide compound (8) was prepared as light yellow crystals in the same manner as in Synthesis Example 1, except that 6.86 g (0.05 mol) of 5-methoxy-2-methylaniline was used instead of aniline (yield 83%). The $^1$H-NMR (300 MHz, $CDCl_3$) spectrum of the obtained Compound (8) is shown in FIG. 4.

Synthesis Example 4

Synthesis of Compound (20)

The following is a description of the synthesis of the naphthalenetetracarboxylic acid diimide Compound (20) having the formula below, which will be used as an ETM in Comparative Examples 1 and 2.

(20)

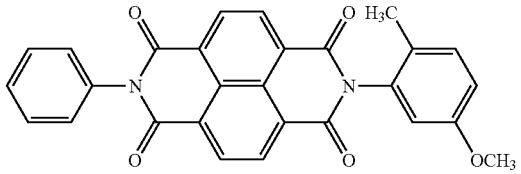

20.7 g of the compound (20) was prepared as light yellow crystals in the same manner as in Synthesis Example 1, except that 6.85 g (0.05 mol) of 5-methoxy-2-methylaniline was used instead of 5-methoxy-2-methyl-4-nitroaniline (yield 90%).

Synthesis Example 5

Synthesis of Compound (30)

The following is a description of the synthesis of the naphthalenetetracarboxylic acid diimide Compound (30) having the formula below, which will be used as an ETM in Comparative Examples 3 and 4.

(30)

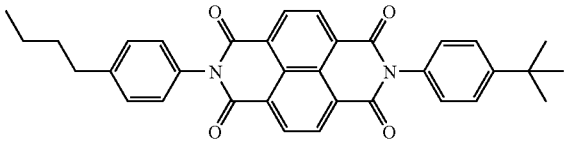

22.2 g of the naphthalenetetracarboxylic acid diimide compound (30) was prepared as light yellow crystals in the same manner as in Synthesis Example 1, except that 7.45 g (0.05 mol) of 4-n-butylaniline was used instead of aniline and 7.45 g (0.05 mol) of 4-t-butylaniline was used instead of 5-methoxy-2-methyl-4-nitroaniline (yield 84%).

Synthesis Example 6

Synthesis of Compound (40)

The following is a description of the synthesis of the naphthalenetetracarboxylic acid diimide Compound (40) having the formula below, which will be used as an ETM in Comparative Examples 5 and 6.

(40)

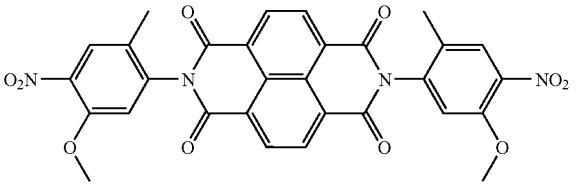

25.4 g of the naphthalenetetracarboxylic acid diimide compound (40) was prepared as light yellow crystals in the same manner as in Synthesis Example 1, except that 18.3 g (0.1 mol) of 5-methoxy-2-methyl-4-nitroaniline was used without using aniline (yield 85%).

Synthesis Example 7

Synthesis of Compound (50)

The following is a description of the synthesis of the naphthalenetetracarboxylic acid diimide Compound (50) having the formula below, which will be used as an ETM in Comparative Examples 7 and 8.

(50)

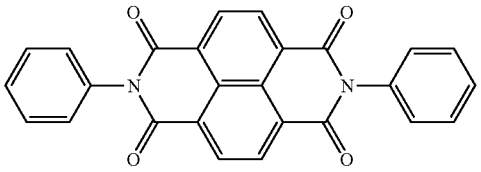

18.2 g of the naphthalenetetracarboxylic acid diimide compound (50) was prepared as light orange crystals in the same manner as in Synthesis Example 1, except that 9.4 g (0.1 mol) of aniline was used without using 5-methoxy-2-methyl-4-nitroaniline (yield 87%).

Example 1

4.5 parts by weight of the naphthalenetetracarboxylic acid diimide Compound (1) obtained in Synthesis Example 1 as an ETM, 0.9 parts by weight of x-type metal free phthalocyanine Compound (9) as a CGM, 9 parts by weight of an enamine-stilben-based compound having Formula (10) as an HTM, 15.9 parts by weight of a binder resin compound (11) (O-PET, available from KANEBO), 84 parts by weight of methylene chloride, and 36 parts by weight of 1,1,2-trichloroethane were sand milled for 2 hours and uniformly dispersed using ultrasonic waves.

The obtained solution was coated on an anodized aluminum drum (a thickness of an anodized film: 5 mm) using a ring coating method and dried at 110° C. for 1 hour to prepare an electrophotographic photoreceptor drum having a thickness of about 14-15 μm.

(9)

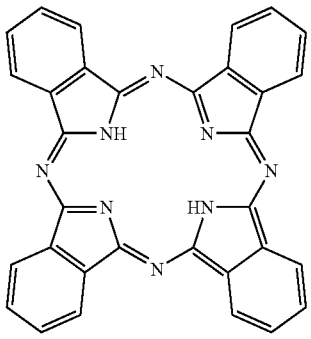

(10)

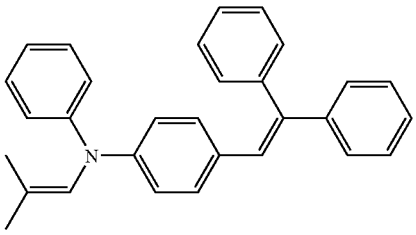

-continued (11)

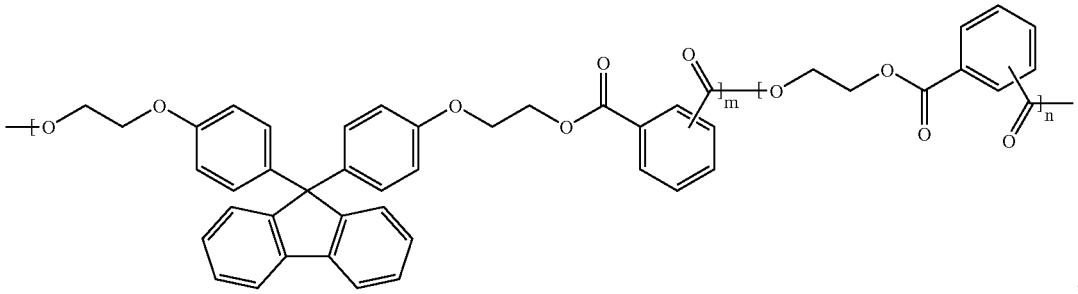

(12)

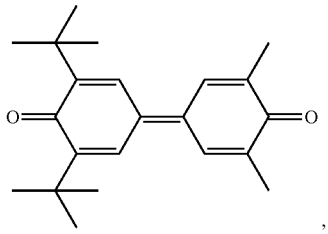

(13)

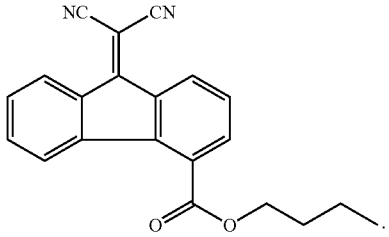

Example 2

An electrophotographic photoreceptor drum was prepared in the same manner as in Example 1, except that the amount of the naphthalenetetracarboxylic acid diimide Compound (1) was changed to 4.05 parts by weight and 0.45 parts by weight of the Compound (9) was further used as an electron acceptor.

Example 3

An electrophotographic photoreceptor drum was prepared in the same manner as in Example 1, except that 4.5 parts by weight of the naphthalenetetracarboxylic acid diimide Compound (2) was used instead of the naphthalenetetracarboxylic acid diimide Compound (1).

Example 4

An electrophotographic photoreceptor drum was prepared in the same manner as in Example 3, except that the amount of the naphthalenetetracarboxylic acid diimide Compound (2) was changed to 4.05 parts by weight and 0.45 parts by weight of the Compound (12) was further used as an electron acceptor.

Example 5

An electrophotographic photoreceptor drum was prepared in the same manner as in Example 1, except that 4.5 parts by weight of the naphthalenetetracarboxylic acid diimide Compound (8) was used instead of the naphthalenetetracarboxylic acid diimide Compound (1).

Example 6

An electrophotographic photoreceptor drum was prepared in the same manner as in Example 5, except that the amount of the naphthalenetetracarboxylic acid diimide Compound (8) was changed to 4.05 parts by weight and 0.45 parts by weight of the Compound (12) was further used as an electron acceptor.

Comparative Example 1

An electrophotographic photoreceptor drum was prepared in the same manner as in Example 1, except that 4.5 parts by weight of the naphthalenetetracarboxylic acid diimide Compound (20) was used instead of the naphthalenetetracarboxylic acid diimide Compound (1).

Comparative Example 2

An electrophotographic photoreceptor drum was prepared in the same manner as in Comparative Example 1, except that the amount of the naphthalenetetracarboxylic acid diimide Compound (20) was changed to 4.05 parts by weight and 0.45 parts by weight of the Compound (12) was further used as an electron acceptor.

Comparative Example 3

An electrophotographic photoreceptor drum was prepared in the same manner as in Example 1, except that 4.5 parts by weight of the naphthalenetetracarboxylic acid diimide Compound (30) was used instead of the naphthalenetetracarboxylic acid diimide Compound (1).

Comparative Example 4

An electrophotographic photoreceptor drum was prepared in the same manner as in Comparative Example 3, except that the amount of the naphthalenetetracarboxylic acid diimide Compound (30) was changed to 4.05 parts by weight and 0.45 parts by weight of the Compound (12) was further used as an electron acceptor.

Comparative Example 5

An electrophotographic photoreceptor drum was prepared in the same manner as in Example 1, except that 4.5 parts by weight of the naphthalenetetracarboxylic acid diimide Compound (40) was used instead of the naphthalenetetracarboxylic acid diimide Compound (1).

Comparative Example 6

An electrophotographic photoreceptor drum was prepared in the same manner as in Comparative Example 5, except that the amount of the naphthalenetetracarboxylic acid diimide Compound (40) was changed to 4.05 parts by weight and 0.45 parts by weight of the Compound (12) was further used as an electron acceptor.

Comparative Example 7

An electrophotographic photoreceptor drum was prepared in the same manner as in Example 1, except that 4.5 parts by weight of the naphthalenetetracarboxylic acid diimide Compound (50) was used instead of the naphthalenetetracarboxylic acid diimide Compound (1).

Comparative Example 8

An electrophotographic photoreceptor drum was prepared in the same manner as in Comparative Example 7, except that the amount of the naphthalenetetracarboxylic acid diimide Compound (50) was changed to 4.05 parts by weight and 0.45 parts by weight of the Compound (12) was further used as an electron acceptor.

Comparative Example 9

An electrophotographic photoreceptor drum was prepared in the same manner as in Example 1, except that 4.5 parts by weight of the dicyanofluorene Compound (13) was used instead of the naphthalenetetracarboxylic acid diimide Compound (1).

Comparative Example 10

An electrophotographic photoreceptor drum was prepared in the same manner as in Comparative Example 9, except that the amount of the dicyanofluorene Compound (13) was changed to 4.05 parts by weight and 0.45 parts by weight of the Compound (12) was further used as an electron acceptor.

Comparative Example 11

An electrophotographic photoreceptor drum was prepared in the same manner as in Example 1, except that 13.5 parts by weight of the enamine stilben Compound (10) was used instead of the naphthalenetetracarboxylic acid diimide Compound (1).

Comparative Example 12

An electrophotographic photoreceptor drum was prepared in the same manner as in Comparative Example 11, except that the amount of the enamine stilben Compound (10) was changed to 13.05 parts by weight and 0.45 parts by weight of the Compound (12) was further used as an electron acceptor.

Experimental Example

Electrostatic properties of the respective electrophotographic photoreceptors prepared in the above Examples and Comparative Examples were measured using a scorotron-charging type drum photoreceptor evaluation apparatus manufactured by the Applicant of the present invention. The initial charge and exposure potentials and the charge and exposure potentials after 3,000 cycles were measured. The measured results are shown in Table 1. The drum photoreceptor evaluation apparatus has a drum diameter of 30 mm and a drum revolution speed of 5 ips (inch/second). The conditions of evaluation were as follows. A grid voltage (Vg)=1.0 kV, a wire current (Iw)=300 uA, and laser supply unit (LSU) electrical power=0.9 mW.

TABLE 1

| | HTM | ETM | Electron acceptor (EA) | Surface crystallization | $V_{d\ initial}$ (V) | $V_{d\ 3000}$ (V) | $\Delta V_d$ (V) | $V_{o\ initial}$ (V) | $V_{o\ 3000}$ (V) | $\Delta V_o$ (V) |
|---|---|---|---|---|---|---|---|---|---|---|
| Example 1 | ○ | Compound (1) | X | No | 77 | 83 | 6 | 850 | 850 | 0 |
| Example 2 | ○ | Compound (1) | ○ | No | 62 | 67 | 5 | 835 | 835 | 0 |
| Example 3 | ○ | Compound (2) | X | No | 75 | 80 | 5 | 845 | 843 | 2 |
| Example 4 | ○ | Compound (2) | ○ | No | 68 | 72 | 4 | 842 | 842 | 0 |
| Example 5 | ○ | Compound (8) | X | No | 72 | 80 | 8 | 867 | 865 | 2 |
| Example 6 | ○ | Compound (8) | ○ | No | 60 | 67 | 7 | 860 | 860 | 0 |
| Comparative Example 1 | ○ | Compound (20) | X | No | 85 | 90 | 5 | 850 | 809 | 41 |
| Comparative Example 2 | ○ | Compound (20) | ○ | No | 84 | 90 | 6 | 866 | 850 | 16 |
| Comparative Example 3 | ○ | Compound (30) | X | No | 87 | 91 | 4 | 864 | 822 | 42 |
| Comparative Example 4 | ○ | Compound (30) | ○ | No | 88 | 92 | 4 | 870 | 852 | 18 |
| Comparative Example 5 | ○ | Compound (40) | X | Yes | 184 | 190 | 6 | 695 | 530 | 165 |
| Comparative Example 6 | ○ | Compound (40) | ○ | Yes | 155 | 160 | 5 | 695 | 524 | 171 |

TABLE 1-continued

| | HTM | ETM | Electron acceptor (EA) | Surface crystallization | $V_{d\ initial}$ (V) | $V_{d\ 3000}$ (V) | $\Delta V_d$ (V) | $V_{o\ initial}$ (V) | $V_{o\ 3000}$ (V) | $\Delta V_o$ (V) |
|---|---|---|---|---|---|---|---|---|---|---|
| Comparative Example 7 | ○ | Compound (50) | X | Yes | 195 | 200 | 5 | 827 | 644 | 183 |
| Comparative Example 8 | ○ | Compound (50) | ○ | Yes | 155 | 158 | 3 | 808 | 627 | 181 |
| Comparative Example 9 | ○ | Compound (10) | X | No | 110 | 132 | 22 | 825 | 645 | 180 |
| Comparative Example 10 | ○ | Compound (13) | ○ | No | 100 | 107 | 7 | 875 | 809 | 66 |
| Comparative Example 11 | ○ | — | X | No | 150 | 165 | 15 | 750 | 565 | 185 |
| Comparative Example 12 | ○ | — | ○ | No | 134 | 140 | 6 | 723 | 597 | 126 |

In Table 1, $V_{o\ initial}$ denotes an initial charge potential, $V_{d\ inital}$ denotes an initial exposure potential, $V_{o\ 3000}$ denotes a charge potential after 3000 cycles, and $V_{d\ 3000}$ denotes an exposure potential after 3000 cycles. $\Delta V_d$ refers to an increase in the exposure potential after 3000 cycles, i.e., $\Delta V_d = V_{d\ 3000} - V_{d\ initial}$.

$\Delta V_o$ refers to a decrease in the charge potential after 3000 cycles, i.e., $\Delta V_o = V_{o\ initial} - V_{o\ 3000}$.

Referring to Table 1, in the case of Examples 1 through 6 using the asymmetric naphthalenetetracarboxylic acid diimide Compound (1), (2) or (8) having a nitro group, according to the present invention, $\Delta V_o$=0-2 V, i.e., the charge potential after 3000 cycles exhibited little or no decrease.

In contrast, Comparative Examples 1 through 4 using the asymmetric naphthalenetetracarboxylic acid diimide Compound (20) or (30) that did not have a nitro group, $\Delta V_o$=16-42 V, i.e., the charge potential significantly decreased after 3000 cycles, the Compounds 20 and 30 are described in U.S. Pat. No. 4,992,349, as an ETM. Comparative Examples 2 and 4, in which electron acceptors were used in the production of the photoreceptor, $\Delta V_o$=16-18 V, was less than the decrease in the charge potential $\Delta V_o$=41-42 V of Comparative Examples 1 and 3, where the electron acceptors were not used in the production of the photoreceptor. Thus, it was confirmed that when an asymmetric naphthalenetetracarboxylic acid diimide compound without a nitro group is used as an ETM, a decrease in the charge potential can be reduced by using the electron acceptor in the production of the photoreceptor. However, in Examples 1 through 6, the charge potential showed little or no decrease, i.e., an electrostatic property was excellent even though the electron acceptor was not used. That is, the charge potential even after several thousand cycles is not greatly decreased in the electrophotographic photoreceptor using the asymmetric naphthalenetetracarboxylic acid diimide compound having a nitro group according to the present invention as the ETM. Therefore, the lifetime of the electrophotographic photoreceptor can be extended. Also, the image quality can be maintained after a use for an extended time.

Comparative Examples 5 through 12, confirm that both $\Delta V_o$ and $\Delta V_d$ were large and thus, the electrostatic property is poor. In particular, Comparative Examples 5 through 8, using the symmetric naphthalenetetracarboxylic acid diimide compounds as the ETM, exhibited surfaces of the photoreceptors that were crystallized in the production of the electrophotographic photoreceptor drums due to low solubility in an organic solvent and low compatibility with a polymer binder resin of the symmetric naphthalenetetracarboxylic acid diimide compounds. Thus, the electrostatic property was remarkably deteriorated compared to the Examples 1 through 6.

As described above, an asymmetric naphthalenetetracarboxylic acid diimide compound having a nitro group according to the present invention has high electron transporting ability, solubility in an organic solvent, and compatibility with a binder resin. Thus, an electrophotographic photoreceptor containing the asymmetric naphthalenetetracarboxylic acid diimide compound according to the present invention can maintain a constant surface potential after being repeatedly used for an extended time. Thus, when the electrophotographic photoreceptor can provide a high image quality for an extended time.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An electrophotographic photoreceptor comprising:

an electrically conductive substrate; and a photosensitive layer formed on the support, wherein the photosensitive layer comprises a naphthalenetetracarboxylic acid diimide derivative of Formula (1):

(1)

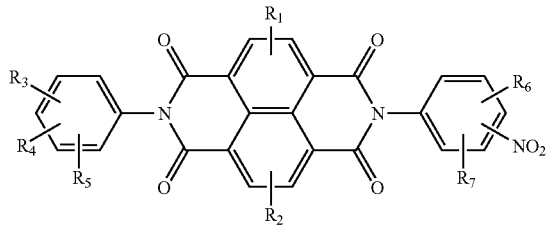

wherein $R_1$, $R_2$, $R_3$, $R_4$, $R_5$, $R_6$, and $R_7$ are independently selected from the group consisting of a hydrogen atom, a halogen atom, a substituted or unsubstituted $C_{1-20}$ alkyl group, a substituted or unsubstituted $C_{1-20}$ alkoxy group, a substituted or unsubstituted $C_{6-30}$ aryl group, and a substituted or unsubstituted $C_{7-30}$ aralkyl group.

2. An electrophotographic photoreceptor comprising:

an electrically conductive substrate;

an intermediate layer formed on the electrically conductive substrate; and a photosensitive layer formed on the intermediate layer, wherein the intermediate layer comprising a naphthalenetetracarboxylic acid diimide derivative of Formula (1):

(1)

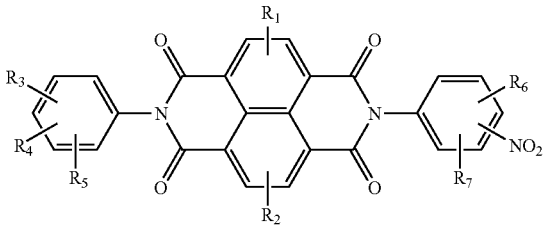

wherein $R_1$, $R_2$, $R_3$, $R_4$, $R_5$, $R_6$, and $R_7$ are independently selected from the group consisting of a hydrogen atom, a halogen atom, a substituted or unsubstituted $C_{1-20}$ alkyl group, a substituted or unsubstituted $C_{1-20}$ alkoxy group, a substituted or unsubstituted $C_{6-30}$ aryl group, and a substituted or unsubstituted $C_{7-30}$ aralkyl group.

3. An electrophotographic imaging apparatus comprising:

an electrophotographic photoreceptor comprising:

an electrically conductive substrate; and a photosensitive layer formed on the electrically conductive substrate, wherein the photosensitive layer comprises a naphthalenetetracarboxylic acid diimide derivative of Formula (1):

(1)

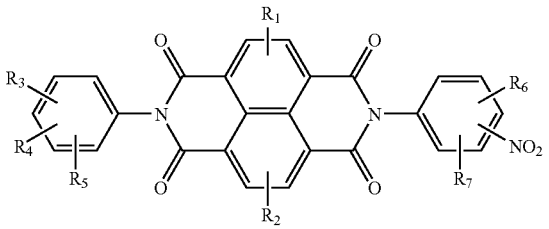

wherein $R_1$, $R_2$, $R_3$, $R_4$, $R_5$, $R_6$, and $R_7$ are independently selected from the group consisting of a hydrogen atom, a halogen atom, a substituted or unsubstituted $C_{1-20}$ alkyl group, a substituted or unsubstituted $C_{1-20}$ alkoxy group, a substituted or unsubstituted $C_{6-30}$ aryl group, and a substituted or unsubstituted $C_{7-30}$ aralkyl group.

4. An electrophotographic imaging apparatus comprising:

an electrophotographic photoreceptor comprising:

an electrically conductive substrate;

an intermediate layer formed on the electrically conductive substrate; and a photosensitive layer formed on the intermediate layer, wherein the intermediate layer comprises a naphthalenetetracarboxylic acid diimide derivative of Formula (1):

(1)

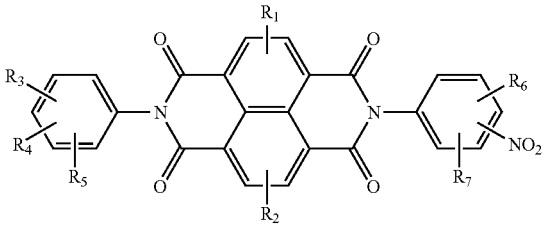

wherein $R_1$, $R_2$, $R_3$, $R_4$, $R_5$, $R_6$, and $R_7$ are independently selected from the group consisting of a hydrogen atom, a halogen atom, a substituted or unsubstituted $C_{1-20}$ alkyl group, a substituted or unsubstituted $C_{1-20}$ alkoxy group, a substituted or unsubstituted $C_{6-30}$ aryl group, and a substituted or unsubstituted $C_{7-30}$ aralkyl group.

5. An electrophotographic cartridge comprising:

an electrophotographic photoreceptor comprising:

an electrically conductive substrate; and a photosensitive layer formed on the electrically conductive support; and at least one selected from the group consisting of:

a charging device charging the electrophotographic photoreceptor;

a developing device developing an electrostatic latent image formed on the electrophotographic photoreceptor; and a cleaning device cleaning a surface of the electrophotographic photoreceptor, the electrophotographic cartridge being attachable to or detachable from an imaging apparatus:

wherein the photosensitive layer comprises a naphthalenetetracarboxylic acid diimide derivative of Formula (1):

(1)

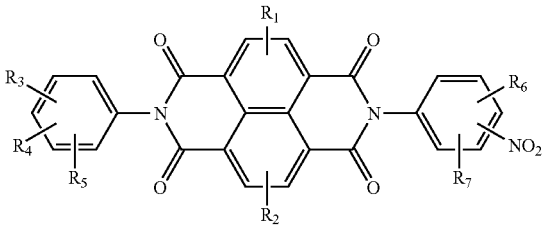

wherein $R_1$, $R_2$, $R_3$, $R_4$, $R_5$, $R_6$, and $R_7$ are independently selected from the group consisting of a hydrogen atom, a halogen atom, a substituted or unsubstituted $C_{1-20}$ alkyl group, a substituted or unsubstituted $C_{1-20}$ alkoxy group, a substituted or unsubstituted $C_{6-30}$ aryl group, and a substituted or unsubstituted $C_{7-30}$ aralkyl group.

6. An electrophotographic cartridge comprising:

an electrophotographic photoreceptor comprising:

a electrically conductive substrate;

an intermediate layer formed on the electrically conductive substrate;

a photosensitive layer formed on the intermediate layer; and at least one selected from the group consisting of:

a charging device charging the electrophotographic photoreceptor;

a developing device developing an electrostatic latent image formed on the electrophotographic photoreceptor; and a cleaning device cleaning a surface of the electrophotographic photoreceptor, the electrophotographic cartridge being attachable to or detachable from an imaging apparatus:

wherein the intermediate layer comprises a naphthalenetetracarboxylic acid diimide derivative of Formula (1):

(1)

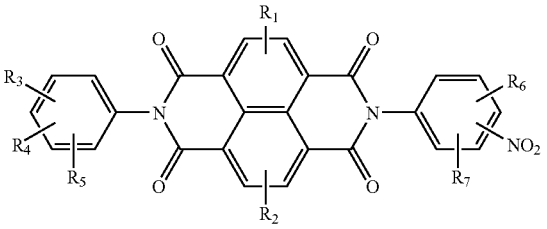

wherein $R_1$, $R_2$, $R_3$, $R_4$, $R_5$, $R_6$, and $R_7$ are independently selected from the group consisting of a hydrogen atom, a halogen atom, a substituted or unsubstituted $C_{1-20}$ alkyl group, a substituted or unsubstituted $C_{1-20}$ alkoxy group, a substituted or unsubstituted $C_{6-30}$ aryl group, and a substituted or unsubstituted $C_{7-30}$ aralkyl group.

7. An electrophotographic drum comprising:

a drum attachable to and detachable from an imaging apparatus; and an electrophotographic photoreceptor disposed on the drum, the electrophotographic photoreceptor comprising:

an electrically conductive substrate; and a photosensitive layer formed on the electrically conductive support, wherein the photosensitive layer comprises a naphthalenetetracarboxylic acid diimide derivative of Formula (1):

(1)

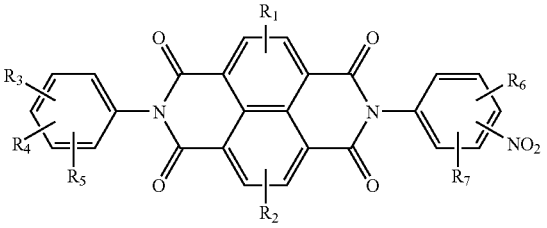

wherein $R_1$, $R_2$, $R_3$, $R_4$, $R_5$, $R_6$, and $R_7$ are independently selected from the group consisting of a hydrogen atom, a halogen atom, a substituted or unsubstituted $C_{1-20}$ alkyl group, a substituted or unsubstituted $C_{1-20}$ alkoxy group, a substituted or unsubstituted $C_{6-30}$ aryl group, and a substituted or unsubstituted $C_{7-30}$ aralkyl group.

8. An electrophotographic drum comprising:

a drum attachable to and detachable from an imaging apparatus; and an electrophotographic photoreceptor disposed on the drum, the electrophotographic photoreceptor comprising:

an electrically conductive substrate;

an intermediate layer formed on the electrically conductive substrate; and a photosensitive layer formed on the intermediate layer, wherein the intermediate layer comprises a naphthalenetetracarboxylic acid diimide derivative of Formula (1):

(1)

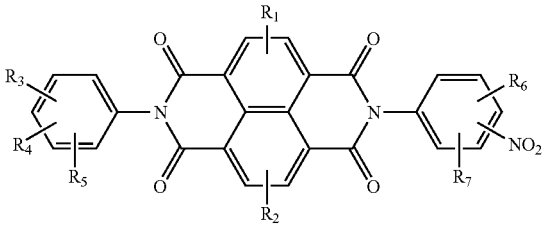

wherein $R_1$, $R_2$, $R_3$, $R_4$, $R_5$, $R_6$, and $R_7$ are independently selected from the group consisting of a hydrogen atom, a halogen atom, a substituted or unsubstituted $C_{1-20}$ alkyl group, a substituted or unsubstituted $C_{1-20}$ alkoxy group, a substituted or unsubstituted $C_{6-30}$ aryl group, and a substituted or unsubstituted $C_{7-30}$ aralkyl group.

9. An imaging apparatus comprising:

a photoreceptor unit comprising:

an electrically conductive substrate; and a photosensitive layer formed on the electrically conductive support, a charging device charging the photoreceptor unit;

an image forming light irradiating device for irradiating light onto the charged photoreceptor unit to form an electrostatic latent image on the photoreceptor unit;

a developing unit for developing the electrostatic latent image with a toner to form a toner image on the photoreceptor unit; and a transfer device for transferring the toner image onto a receptor:

wherein the photosensitive layer comprises a naphthalenetetracarboxylic acid diimide derivative of Formula (1):

(1)

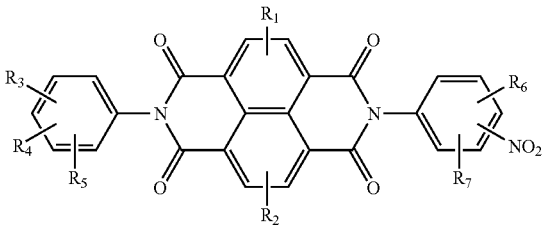

wherein $R_1$, $R_2$, $R_3$, $R_4$, $R_5$, $R_6$, and $R_7$ are independently selected from the group consisting of a hydrogen atom, a halogen atom, a substituted or unsubstituted $C_{1-20}$ alkyl group, a substituted or unsubstituted $C_{1-20}$ alkoxy group, a substituted or unsubstituted $C_{6-30}$ aryl group, and a substituted or unsubstituted $C_{7-30}$ aralkyl group.

10. An imaging apparatus comprising:

a photoreceptor unit comprising:

an electrically conductive substrate;

an intermediate layer formed on the electrically conductive substrate; and a photosensitive layer formed on the intermediate layer, a charging device charging the photoreceptor unit;

an image forming light irradiating device for irradiating light onto the charged photoreceptor unit to form an electrostatic latent image on the photoreceptor unit;

a developing unit for developing the electrostatic latent image with a toner to form a toner image on the photoreceptor unit; and a transfer device for transferring the toner image onto a receptor:

wherein the photosensitive layer comprises a naphthalenetetracarboxylic acid diimide derivative of Formula (1):

(1)
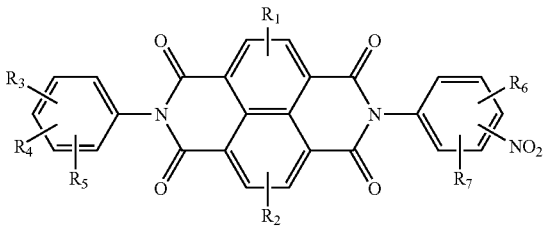
wherein
$R_1$, $R_2$, $R_3$, $R_4$, $R_5$, $R_6$, and $R_7$ are independently selected from the group consisting of a hydrogen atom, a halogen atom, a substituted or unsubstituted $C_{1-20}$ alkyl group, a substituted or unsubstituted $C_{1-20}$ alkoxy group, a substituted or unsubstituted $C_{6-30}$ aryl group, and a substituted or unsubstituted $C_{7-30}$ aralkyl group.
* * * * *